US005452546A

United States Patent [19]

Goddard

[11] Patent Number: 5,452,546

[45] Date of Patent: Sep. 26, 1995

[54] DRAIN GUARD

[76] Inventor: Steven C. Goddard, 1068 Marland Dr. N., Columbus, Ohio 43224

[21] Appl. No.: 155,722

[22] Filed: Nov. 22, 1993

[51] Int. Cl.[6] ..... E04D 13/08; B01D 35/00

[52] U.S. Cl. ..... 52/12; 52/16; 210/170; 210/499

[58] Field of Search ..... 52/12, 16; 210/170, 210/499

[56] References Cited

U.S. PATENT DOCUMENTS

| | | | |
|---|---|---|---|
| 2,494,780 | 1/1950 | Schmidt . | |
| 2,658,625 | 11/1953 | Rafferty | 210/499 |
| 2,887,073 | 5/1959 | Thompson . | |
| 4,447,325 | 5/1984 | Pauley | 210/499 X |
| 4,608,786 | 9/1986 | Beam | 52/12 X |
| 4,798,028 | 1/1989 | Pinion | 52/16 |
| 4,801,377 | 1/1989 | Bolt . | |
| 4,807,406 | 2/1989 | Densmore | 52/12 X |
| 5,114,594 | 5/1992 | Rosebrock et al. | 52/12 X |
| 5,178,752 | 1/1993 | McKinnon | 210/499 X |
| 5,220,755 | 6/1993 | Roles | 52/16 |

FOREIGN PATENT DOCUMENTS

| | | | |
|---|---|---|---|
| 6716785 | 6/1969 | Sweden | 52/12 |

*Primary Examiner*—Wynn E. Wood

[57] ABSTRACT

A device for preventing debris from clogging downsprouts (22) and underground drain pipes (26) consisting of a cap (32), screen (26), and base (34). This device totally screens and contains the water flow. The screen (26) is easily removable by sliding the cap (32) up over the downspout (22). The amount of debris accumulation can be easily observed because either the cap (32) or base (34) is transparent.

3 Claims, 2 Drawing Sheets

DRAIN GUARD

BACKGROUND—FIELD OF INVENTION

This invention relates to protective devices to prevent debris from clogging gutters and elements of gutter draining systems, such as the downspout and the underground drain which connects to the downspout to the curb gutter or other underground sewer.

BACKGROUND—DESCRIPTION OF PRIOR ART

Many devices for preventing debris accumulation in the gutter involve screens to cover the gutter. These screening systems must balance the object to obstruct the entry of all debris but still allow the free entry of water. All conceivable compromises are imperfect allowing some debris entry or causing water overflow of the gutter. Other devices concede a limited accumulation of debris in the gutter and prevent the entry of debris into the downspout by various screens. All of the above require periodic, inconvenient, and some what hazardous maintenance.

Other devices concede the entry of some debris into the downspout and attempt to prevent entry into the underground drain pipe and attempt to provide automatic or convenient debris removal. U.S. Pat. No. 2,494,780 to Schmidt discloses a tinned separator installed in a vertical downspout. While this invention prevents further progression of debris into the downspout and provides for convenient debris removal, it does not totally contain the flow of water. U.S. Pat. No. 2,887,073 to Thompson discloses a removable basket in a section of a downspout. It should be noted that removal of the basket is hardly convenient. Note in FIGS. 4 thru 6 that there is a high probability that debris will accumulate between the basket expanded portion of the downspout. This is because the water and the debris it carries will tend to follow the sides of the downspout rather than separate from the walls of the downspout and drop into the basket. During removal of the basket this debris will drop into the inlet to the underground drain pipe, and thus nullify the object of the assembly. Further, note that the tendency of the water to adhere to the sides of the downspout will tend to cause leakage around the basket removal door. U.S. Pat. No. 4,801,377 to Bolt discloses a debris separator which amounts to an angled grating inserted into a downspout having an opened side. Again, the flow of water is not totally contained. U.S. Pat. No. 5,114,594 to Rosebrock discloses a flow diverter having a cap capable of being removed and slid up over the downspout. However, removal of the screen is still very difficult. The downspout comes close enough to the base that a tedious tilting of the screen is necessary for screen removal. This tilting is likely to dump debris into the stream of the diverted flow. Moreover, the screen is planer, having no height at all. This means that a very small accumulation of debris will clog the device and therefore frequent removal and clearing of the screen will be required.

OBJECTS AND ADVANTAGES

Several objects and advantages of the present invention are:

(a) To provide a drain guard that totally contains the flow of the water.

(b) To provide a drain guard that totally contains the debris when the strainer is removed in such a way that there is no tendency of the debris to progress to subsequent elements.

(c) To provide a drain guard that allows extremely convenient removal, emptying, and replacing of the straining element.

(d) To provide a means of easily assessing whether debris quantity warrants removal without any disassembly of the guard.

DRAWING FIGURES

In the drawings

Figure 1:
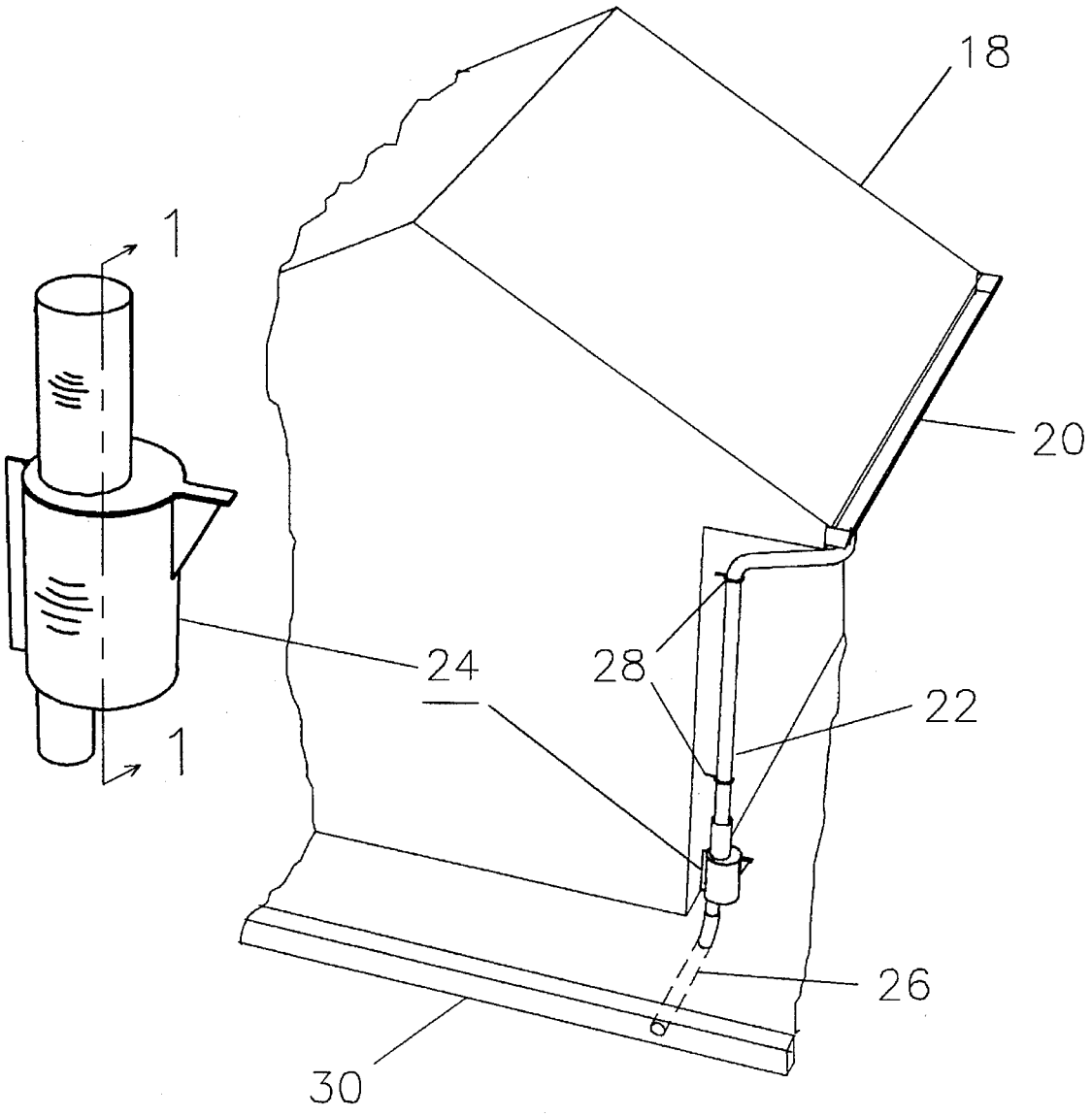
FIG. 1 illustrates a typical installation.

| Reference Numerals in Drawings | |
|---|---|
| 18 | Building |
| 20 | Roof gutter |
| 22 | Downspout |
| 24 | Drain guard assembly |
| 26 | Underground drain pipe leading to curb gutter |
| 28 | Brackets to support downspout |
| 10 | Base outlet |
| 12 | planar section of screen |
| 32 | Cap |
| 33 | Cap outlet |
| 34 | Base |
| 36 | Screen |
| 37 | Screen inlet |
| 38 | Screen handle |
| 40 | Base mounting tab |
| 42 | Base protuberance for screen handle |

DESCRIPTION—FIGS. 1 TO 2

A downspout 22 is connected to the roof gutter 20. The downspout 22 is supported by brackets 28 in such a manner that the brackets 28 support the entire weight of the downspout 22 and provide proper spacing from the building 18 so that the downspout 22 inserts into the drain guard assembly 24. The drain guard assembly 24 is attached to the building 18 by appropriate bracket 31 attached to a mounting tab 40 on the base 34 of the drain guard assembly 24. The drain guard assembly 24 discharges to the underground drain 26 which leads to the curb gutter 30 or other appropriate drainage.

The drain guard assembly 24 consist of a cap 32, a screen 36, and a base 34. The cap 32 receives the discharge of the downspout 22. The top plane of the cap 23 extends above the bottom plane of the downspout 22 and completely surrounds the downspout 22 bottom plane. The cap 32 rests on and discharges into the screen 36. The top plane of the screen 36 extends above the bottom plane of the cap 23 and completely surrounds the bottom plane of the cap 23. The screen 36 has a planar section 12 which discharges into the base 34. The screen 36 rests on the base 34 and is surrounded by the base 34. The highest opening in the screen 36 is below the top of the base 34. The screen 36 has a handle 38 to facilitate removal. This handle 38 is accessible from external to the base 34. The top of the screen 36 and it's handle 38 form a cover for the base. The outlet 10 of the base 34 is smaller in diameter and extends below the inlet of the underground drain pipe 26. The base 34 has a protuberance for the screen handle.

Figure 2:
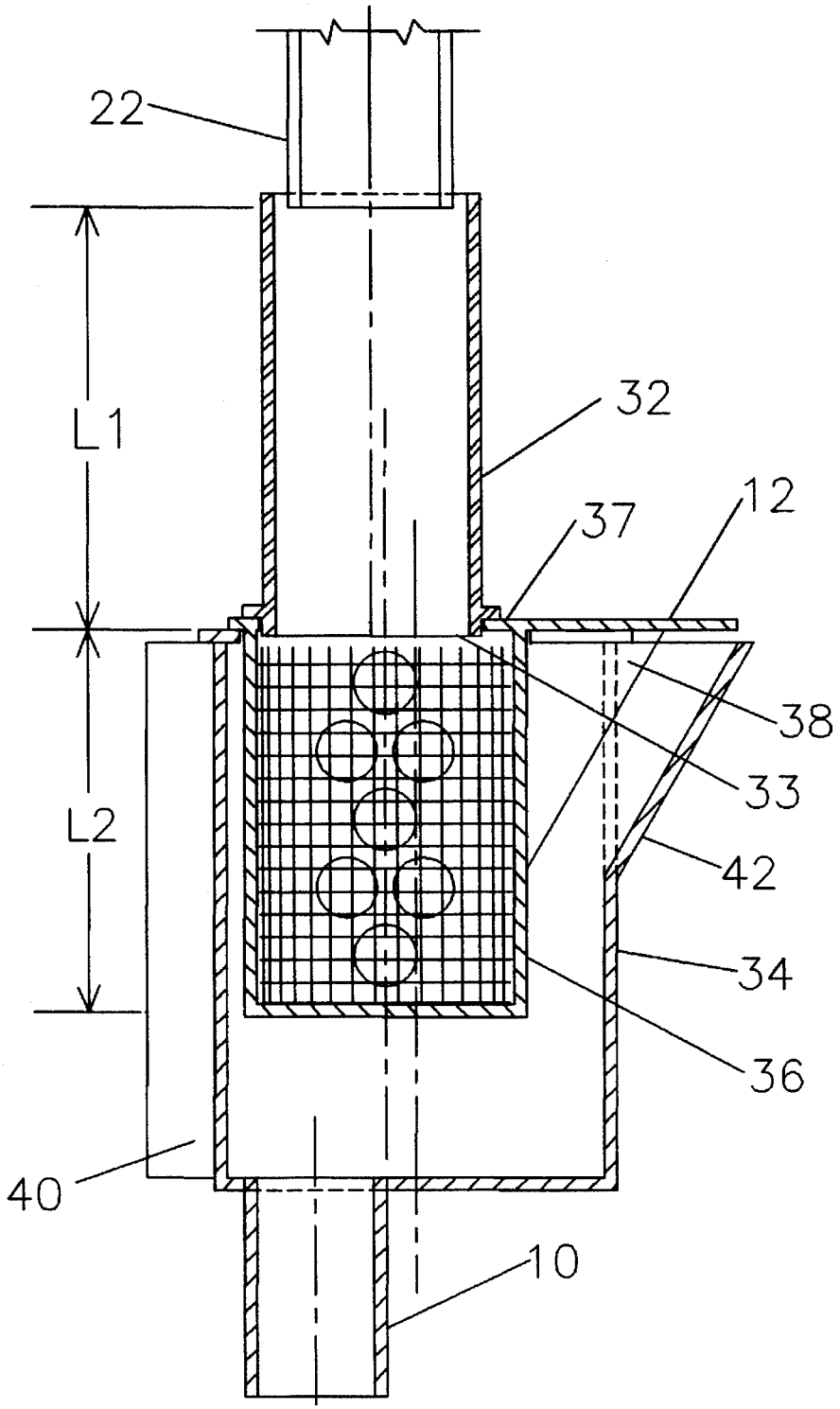
FIG. 2 shows a diametral section through the drain guard assembly.

The cap 32, base 34, and strainer 36 should be made from corrosion resistant metals or plastics. Either the cap 32 or the base 34 should be made from a transparent plastic. The distance between the bottom of the downspout 22 and the top of the base 34 (i.e. L1 FIG. 2) is larger then the height of the strainer 36 (i.e. L2 FIG. 2) The distance from the bottom of the downspout 22 to the lowest downspout 22 support bracket 28 is greater than the height of the cap 32. In the preferred embodiment shown all components of the drain guard assembly 24 are circular cylinders.

OPERATION—FIGS. 1 & 2

Water and debris flow from the roof gutter 20 and into the downspout 22. The downspout 22 discharges into the screen 34. The screen 36 traps the debris and discharges into the base 34. This discharge is primarily circumferential. The base discharges into the underground drain pipe 26. Since the inlet opening of each succeeding element is larger than and above the outlet of the each preceding element the water flow is totally contained.

The magnitude of debris accumulation is easily observable since either the cap 32 or base 34 is transparent.

To remove debris the cap 32 is slide up over the downspout 22. The screen 36 is lifted up and out of the base 34 by means of the handle 38. The screen 36 is then moved laterally till it clears both the base 34 and cap 32. It may then be emptied by simply inverting or if necessary shaken or sprayed with a garden hose. Since the screen 36 completely surrounds the debris horizontally and vertically there is no tendency of the debris to fall into the base 34 while the screen 36 is being removed. To reinstall, the cap 32 is held up over the downspout 22.The screen 36 is then moved laterally over the opening the base 34, and lowered into the base 34. The cap 32 is then lowered onto the screen 36.

Although the above description contains many details, these should not be considered to limit the scope of the invention, but merely illustrate the presently preferred embodiment. Other configurations are possible. For example the cap 32, screen 36, and base 34 may be rectangular, elliptical, or other shaped cylinders. These may even be non cylindrical,(i.e. tapered, conical) The illustrated unit has appreciable size. Larger units allow more time between debris clearing and can pass larger quantities of water. Smaller units have more aesthetic appeal and can be installed at locations prohibitive for larger sizes. FIG. 1 illustrates a ground level installation. This is advantageous for maintenance but does not protect the downspout. A smaller unit could be installed higher in the downspout, if required, before the first major bend. The ease of screen removal and would still offer significant advantages. A transparent base would still allow accumulation observation from the ground.

The scope of the invention should be determined by the following claims and their legal equivalents.

What is claimed is as follows:

1. A drain guard device comprising a cap, a screen, and base:

a. the cap having a length cylindrical in shape, said cap having an inlet and an outlet, the inlet being higher than the outlet, said cap inlet having sufficient diameter to receive a typical downspout, said cap being easily slid up over a typical downspout to allow easy removal of the screen, b. the screen having a length portion cylindrical in shape extending into the base, said screen an inlet and also having a planer portion, said planer portion of said screen supporting said cap, said planer portion of said screen having an opening that constitutes the inlet of said screen, said screen inlet being higher than said outlet of said cap, said planer portion of said screen forming a cover for the base, said screen having openings in said cylindrical portion to allow circumferential passage of a fluid while retaining solid debris, c. the base having an upper section and an outlet, said upper section having a diameter and being cylindrical in shape, said upper section supporting said planer section of said screen, said upper section of said base being larger in cross section and totally surrounding said cylindrical length portion of said screen, said outlet of said base having an opening for discharge of fluid, said outlet of said base having a diameter less than the diameter of said upper section, said outlet extending into a typical underground drain pipe.

2. The device of claim 1 wherein said screen has a handle accessible external to said base.

3. The device of claim 1 wherein said base has a protuberance to accommodate said handle of said screen.

* * * * *